US005360148A

United States Patent [19]

Goscin et al.

[11] Patent Number: 5,360,148

[45] Date of Patent: Nov. 1, 1994

[54] HANGERED SHIRT COLLAR PROTECTOR

[76] Inventors: Edmund J. Goscin; David K. Goscin, both of 7620 Fallmeadow La., Dallas, Tex. 75248

[21] Appl. No.: 1,059

[22] Filed: Jan. 6, 1993

[51] Int. Cl.[5] ..... A41D 27/22

[52] U.S. Cl. ..... 223/88; 223/85

[58] Field of Search ..... 223/88, 52.1, 95, 100, 223/98, 85, 87, 2, 3, 4, 52.2, 52.3, 52.4

[56] References Cited

U.S. PATENT DOCUMENTS

| | | | |
|---|---|---|---|
| 2,692,710 | 10/1954 | Lee | 223/52.1 |
| 2,723,765 | 11/1955 | Meredith | 223/87 |
| 2,738,112 | 3/1956 | Miller | 223/85 |
| 2,750,087 | 6/1956 | Antal | 223/88 |
| 3,032,242 | 5/1962 | Roberts | 223/87 |
| 3,531,027 | 9/1970 | Malmin | 223/88 |
| 3,623,248 | 11/1970 | Jones | 223/52.1 |
| 4,219,140 | 8/1980 | Simonoff | 223/87 |

*Primary Examiner*—Clifford D. Crowder
*Assistant Examiner*—Larry D. Worrell, Jr.
*Attorney, Agent, or Firm*—L. Dan Tucker

[57] ABSTRACT

A hangered shirt collar protector is provided comprising a strip of flexible material formed into a substantially cylindrical shape by fastening together opposite edges, and the flexible material further having a hole to receive the hook portion of a garment hanger. The protector will support the collar portion of a hangered shirt so that the collar will not become bent and wrinkled.

9 Claims, 1 Drawing Sheet

HANGERED SHIRT COLLAR PROTECTOR

BACKGROUND OF THE INVENTION

The present invention relates to collar protection for hangered shirts, and more particularly to a cylindrical member that is used on a garment hanger to support the collar portion of a shirt so that the collar will not become bent and wrinkled.

Generally, freshly pressed shirts are placed on garment hangers to await use. The hangers support only the shoulder portions of the shirt, so the collar portion tends to loose its shape. This problem is compounded when adjacent hangered shirts are closely spaced resulting in bent and wrinkled collars. A review of the prior art reveals several collar protectors, but these attempts have been costly, complex or ineffective.

SUMMARY OF THE INVENTION

A primary object of the present invention is to provide a collar protector for hangered shirts that will overcome the shortcomings of the prior art devices.

Another object is to support the collar portion of a shirt so that the collar will not become bent and wrinkled.

An additional object is to provide a collar protector that will also act as a spacer between adjacent hangered shirts.

A further object is to provide a collar protector that is simple and easy to use.

A still further object is to provide a collar protector that is economical in cost to manufacture.

These and other objects of the invention will be apparent to those skilled in the art from the following detailed description of a preferred embodiment of the invention.

BRIEF DESCRIPTION OF THE INVENTION

The hangered shirt collar protector of the present invention provides an improved structure that is easy to manufacture, ship and assemble. The collar protector is comprised of a strip of flexible material formed into a substantially cylindrical shape by overlapping and fastening together two of the opposite edges. The collar protector has a hole through the flexible material to receive the hook of a garment hanger, allowing the protector to support the collar of the garment and to properly space adjacent hangered shirts. Thus, the collar retains its shape and does not become wrinkled.

BRIEF DESCRIPTION OF THE DRAWINGS

The invention will be further described in connection with the accompanying drawings, in which.

DETAILED DESCRIPTION OF THE DRAWINGS

Figure 1:
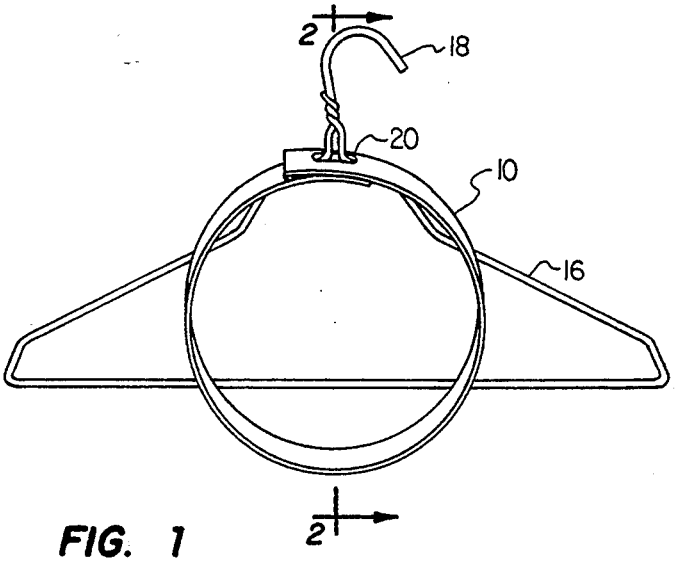
FIG. 1 is a front elevational view of a garment hanger with the collar protector constructed in accordance with the invention and placed thereon.
Figure 2:
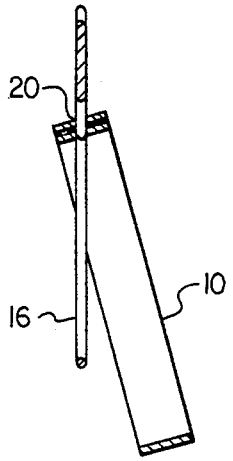
FIG. 2 is a cross-section view through the protector and hanger, taken on section line 2—2 of FIG. 1.

The present invention relates to a hangered shirt or garment collar protector that overcomes many of the disadvantages of the prior art. The collar protector of the present invention is shown in FIG. 1 as it is applied to a conventional wire garment hanger. The collar protector is formed from an elongated rectangular strip of a flexible semi-rigid piece of material 10 such as cardboard or plastic. The rectangular strip of material is cut to a desired size and then the ends are bent to where the top of one end overlaps the bottom of the other end to thereby form a cylindrical shape, as illustrated in FIG. 2. Thus, ends 12 and 14 overlap to form the cylindrical collar protector. Holes 24 and 26 are cut or punched through the rectangular strip of material 10 whereby such holes are aligned when the collar protector is formed by overlapping ends 12 and 14. In a preferred embodiment, the ends 12 and 14, overlapped such that holes 24 and 26 are aligned, are then fastened together. In an alternate embodiment, a hole 25 can be cut or punched through the rectangular strip at any location along the length thereof.

Figure 3:
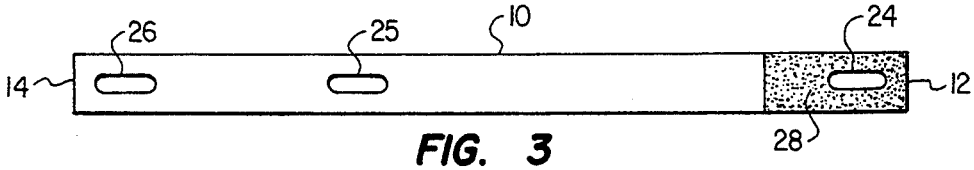
FIG. 3 is a top view of the rectangular material used to form the collar protector.
Figure 4:
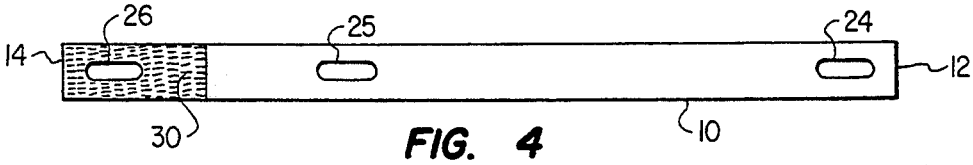
FIG. 4 is a bottom view of the rectangular material.

In a preferred embodiment, the ends are fastened together with an adhesive material to form the generally cylindrical collar protector. In a preferred embodiment, pressure sensitive adhesive materials can be utilized to fasten the overlapping ends of the rectangular strip together. For example, a pressure sensitive adhesive such as tacky polyvinyl chloride pressure sensitive adhesive can be applied in region 28 which is near end 12, as shown in FIG. 3. Likewise, that same adhesive material can be applied to region 30 on the bottom of the rectangular strip of material as shown in FIG. 4. Then as the rectangular strip of material is bent together whereby end 12 overlaps end 14 the strip of material can be adhered together with gentle pressure whereby holes 24 and 26 are aligned. In alternate embodiments, the ends of the rectangular strip can be secured together by any means such as by using tape, glue, staples and tabs.

Figure 5:
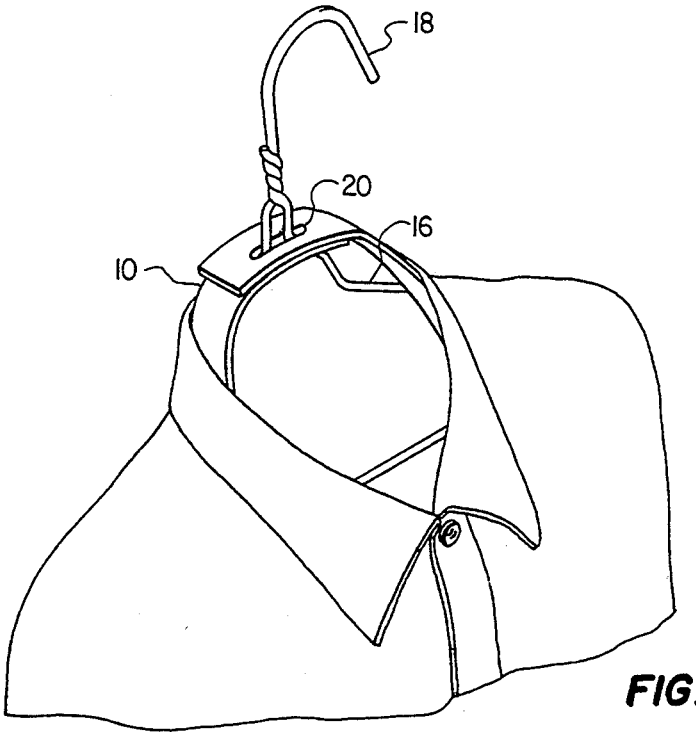
FIG. 5 is a perspective view of a shirt hanging on a conventional wire garment hanger with the collar being supported by the collar protector of this invention.

As shown in FIGS. 1 and 2, aligned hole 20, which is an alignment of holes 24 and 26 can then be placed over hook 18 of conventional wire garment hanger 16. As the cylindrical collar protector is applied to the conventional wire coathanger, it will be noted that it is oriented in such a position as is more clearly illustrated in FIG. 2 whereby it forms a natural support and spacer for a shirt or other collared garment. Thus, as illustrated in FIG. 5, the collar protector 10 provides a cylindrical collar support that will minimize wrinkling and crushing of a collared garment while it is hung on a conventional wire garment hanger.

It will be appreciated that the present invention is not limited to any particular size of collar protectors. However, it has been found that for a normal adult male shirt, a rectangular strip of material having dimensions of approximately $\frac{3}{4}$ inch by 24 inches with an overlap of about 2 inches is quite adequate. In some instances, it will of course be appreciated that the dimensions should be varied whereby the cylindrical collar support is formed from a rectangular strip having a width of greater than $\frac{3}{4}$ inch for the support of high collared garments. Likewise, the length of the strip material can be materially increased or reduced to accommodate garment sizes having smaller or larger neck sirs.

It will be appreciated that the collar protectors of the instant invention can be fabricated from relatively inexpensive materials such as cardboard, plastic and the like. It will also be appreciated that the collar protectors can be fabricated as long strips of material that can be conveniently shipped to users of the protectors such as retailers, laundries and the like and the protectors can be simply and easily formed at the point of use. Thus, an inexpensive and simple collar protector can be formed on an "as needed" basis with the necessity of complicated fabrication or without the necessity of storing bulky prefabricated collar protectors until such time as they are used.

While a preferred form of the invention has been shown in the drawings and described, various modifications will be apparent to those skilled in the art without departing from the scope of the present invention.

We claim:

1. A garment hanger comprising:

(a) a conventional wire garment hanger having a triangular portion to support garments and further having a hook portion extending above the triangular portion;

(b) a strip of flexible semi-rigid material having oppositely disposed first and second ends, the first and second ends disposed in an overlapping relationship to form a substantially cylindrical shape;

(c) means for fastening the first and second ends of the strip together in the overlapping relationship; and (d) an aperture through the strip, wherein the hook portion extends through the aperture to support the strip on the wire hanger.

2. The garment hanger of claim 1 wherein said flexible semi-rigid material is cardboard.

3. The garment hanger of claim 1 wherein said flexible semi-rigid material is plastic.

4. The garment hanger of claim 1 wherein said means for fastening said first and second ends together in said overlapping relationship is a pressure sensitive adhesive.

5. The garment hanger of claim 1 further comprising:

(a) a first hole through said rectangular strip near said first end; and (b) a second hole through said rectangular strip near said second end, whereby said first and second holes are aligned when said first and second ends are placed in said overlapping relationship to form said aperture through said rectangular strip.

6. The garment hanger of claim 4, wherein said flexible semi-rigid material is cardboard.

7. The garment hanger of claim 6 further comprising:

(a) a first hole through said rectangular strip near said first end; and (b) a second hole through said rectangular strip near said second end, whereby said first and second holes are aligned when said first and second ends are placed in said overlapping relationship to form said aperture through said rectangular strip.

8. The garment hanger of claim 4, wherein said flexible semi-rigid material is plastic.

9. The garment hanger of claim 8, further comprising:

(a) a first hole through said rectangular strip near said first end; and (b) a second hole through said rectangular strip near said second end, whereby said first and second holes are aligned when said first and second ends are placed in said overlapping relationship to form said aperture through said rectangular strip.

* * * * *